US008807964B2

(12) United States Patent
Kwon et al.

(10) Patent No.: US 8,807,964 B2
(45) Date of Patent: Aug. 19, 2014

(54) VARIABLE OIL PUMP

(75) Inventors: Hyuk In Kwon, Incheon (KR); Jin Yong Kim, Seoul (KR)

(73) Assignee: Myunghwa Ind. Co., Ltd., Gyeonggi-Do (KR)

( * ) Notice: Subject to any disclaimer, the term of this patent is extended or adjusted under 35 U.S.C. 154(b) by 83 days.

(21) Appl. No.: 13/454,346

(22) Filed: Apr. 24, 2012

(65) Prior Publication Data

US 2013/0142627 A1 Jun. 6, 2013

(30) Foreign Application Priority Data

Dec. 2, 2011 (KR) ..... 10-2011-0128101

(51) Int. Cl.
*F04C 28/26* (2006.01)

(52) U.S. Cl.
USPC ..... 417/410.4; 417/440; 137/118.06; 137/565.35

(58) Field of Classification Search
USPC ..... 137/118.06, 115.14, 119.08, 565.35; 417/410.4, 440; 123/198 C; 184/18
See application file for complete search history.

(56) References Cited

U.S. PATENT DOCUMENTS 3,692,039 A * 9/1972 Ewald et al. ..... 137/115.14
7,011,069 B2 * 3/2006 Ono et al. ..... 123/196 R
7,588,011 B2 9/2009 Ono

FOREIGN PATENT DOCUMENTS

JP 05-179914 A 7/1993
JP 2011-038403 A 2/2011
KR 2005048151 A 5/2005

* cited by examiner

*Primary Examiner* — Bryan Lettman
(74) *Attorney, Agent, or Firm* — Bacon & Thomas, PLLC

(57) ABSTRACT

A variable oil pump capable of rapidly ejecting a required amount of working fluid using an oil pressure of the working fluid generated according to an engine RPM, and improving a lubrication effect to improve engine efficiency. Also described is a variable oil pump, in which a gap is provided between a plunger and a cylinder to easily operate the plunger using an oil pressure output from an oil pump, enabling more rapid supply of a required amount of oil using an oil pressure varied according to variation in an engine RPM. A variable oil pump is described in which the plunger is perpendicularly operated with respect to a flow direction of the working fluid, such that the plunger can be operated in a direction in which a pressure of the working fluid is applied to operate the oil pump.

7 Claims, 12 Drawing Sheets

VARIABLE OIL PUMP

BACKGROUND

1. Field of the Invention

The present invention relates to a variable oil pump, and more particularly, to a variable oil pump capable of, when oil is supplied to a power generating apparatus such as an engine, preventing the oil from being excessively supplied in a medium speed range and a high speed range, sufficiently supplying the oil in a low speed range and a medium/high speed range, and thereby preventing unnecessary supply of the oil with a simple structure.

2. Discussion of Related Art

In general, an engine requires a lubrication apparatus that can lubricate operating components such as a piston and a crankshaft. In particular, the lubrication apparatus requires an oil supply apparatus such as an oil pump that can supply a working fluid such as oil to places where a lubrication operation is needed.

In particular, a rotor-type oil supply apparatus is connected to a crankshaft to be used to adjust an ejected amount of a working fluid in proportion to an engine RPM. Accordingly, a flow rate of an ejected working fluid of a conventional oil supply apparatus is increased in proportion to the engine RPM.

However, since such an oil supply apparatus ejects the working fluid in proportion to the engine RPM regardless of a lubrication state of a portion at which lubrication is needed, fuel efficiency of the engine may be decreased. That is, at the beginning of the engine start of a vehicle, since the working fluid flows downward due to gravity, a larger amount of working fluid is needed to perform sufficient lubrication, and thus, the working fluid should be supplied in proportion to the engine RPM.

However, when a vehicle speed is at a medium speed and a high speed, since a sufficient amount of working fluid is already supplied, there is no need to supply the working fluid in proportion to the engine RPM. In addition, excessive supply of the working fluid at the medium speed and the high speed takes power consumption from the crankshaft, and thus, fuel efficiency of the engine may be decreased.

For this reason, various variable oil pumps configured to supply oil in proportion to a vehicle speed, etc., have been developed. Korean Patent Application No. 10-2005-0048151 (May 24, 2005) discloses a structure of such a variable relief valve. The structure of the variable relief valve, in which a valve chamber is provided at one side of an oil ejection port of an oil pump to adjust a pressure of oil pumped by the oil pump and an oil relief valve is elastically supported in the valve chamber by a spring 33 to drain the oil through a bypass hole formed in one side of the valve chamber according to an oil pressure passing through an oil line, is characterized in that a bimetal 40, a volume of which expands according to variation in temperature, is disposed between an upper surface of a cap 36 fixed to a lower portion of the valve chamber 31 to support a lower end of the spring 33 and a lower surface of a spring seat 37 movably provided at the lower end of the spring 33.

However, such a structure has the following problem. Since the valve is configured to be operated according to variation in temperature, it is difficult to rapidly vary the pressure of the oil, i.e., the oil pressure, according to variation in engine RPM.

SUMMARY OF THE INVENTION

In order to solve these problems, the present invention provides a variable oil pump with a simple structure capable of rapidly ejecting a required amount of working fluid using an oil pressure of the working fluid generated according to an engine RPM, and improving a lubrication effect to improve engine efficiency.

In particular, the present invention also provides a variable oil pump, in which a gap is provided between a plunger and a cylinder to easily operate the plunger using an oil pressure output from an oil pump, capable of more rapidly supplying a required amount of oil using an oil pressure varied according to variation in engine RPM.

In addition, the present invention also provides a variable oil pump, in which the plunger is perpendicularly operated with respect to a flow direction of the working fluid, capable of operating the plunger in a direction in which a pressure of the working fluid is applied to rapidly and precisely operate the oil pump.

In order to accomplish the object, the present invention is directed to a rotor-type variable oil pump configured to vary a pressure and output the pressure according to an engine RPM, wherein an oil pump is provided with a cylinder connected to an outlet side and having a first input pipe and a second input pipe branched from the outlet side, and a first output pipe and a second output pipe branched from an inlet side, a plunger having a first pipe line and a second pipe line is installed in the cylinder to expose one end thereof to the outlet side while being elastically supported by an elastic spring, and the plunger is compressed in a longitudinal direction of the cylinder according to variation in pressure of the outlet side to supply oil in proportion to the engine RPM in a low speed range and a medium/high speed range, the first pipe line connects the first input pipe to the first output pipe to partially return a hydraulic pressure of the outlet side to the inlet side in a medium speed range, and the second pipe line connects the second input pipe to the second output pipe to partially return the hydraulic pressure of the outlet side to the inlet side in a high speed range.

In particular, a protrusion may protrude from a front end of the plunger exposed to the outlet side to maintain a gap, and a receiving hole may be formed in a portion of the cylinder in contact with the protrusion to receive a portion of the protrusion. In addition, the cylinder may be perpendicularly formed with respect to a fluid flow of the outlet side.

Further, the plunger may include a straight section configured to reduce a hydraulic pressure by a certain amount during an initial opening of the first pipe line, and a tapered section configured to gradually reduce a pressure decrease amount from the straight section.

Furthermore, the tapered section (Y) may have a stepped portion at an end thereof.

Finally, the straight section (X) and the tapered section (Y) may have a relation of $0.1X \leq L \leq 0.6X$, here, $(L=X+Y)$.

BRIEF DESCRIPTION OF THE DRAWINGS

The above and other objects, features and advantages of the present invention will become more apparent to those of ordinary skill in the art by describing in detail example embodiments thereof with reference to the attached drawings, in which.

DETAILED DESCRIPTION OF EXAMPLE EMBODIMENTS

Hereinafter, example embodiments of the present invention will be described in detail with reference to the accompanying drawings. Terms used herein and the following claims should not be construed as limited to conventional or dictionary definition but as meanings and concepts meeting with the technical spirit of the present invention based on the principle that the inventor could appropriately define concepts of the terms to described the best mode of the invention.

Accordingly, it will be appreciated by those skilled in the art that the detailed description given herein with respect to these figures is for explanatory purposes as the invention extends beyond these limited embodiments, and various equivalents, modifications and variations may be made in these embodiments without departing from the principles and spirit of the general inventive concept.

[First Embodiment]

Figure 1:
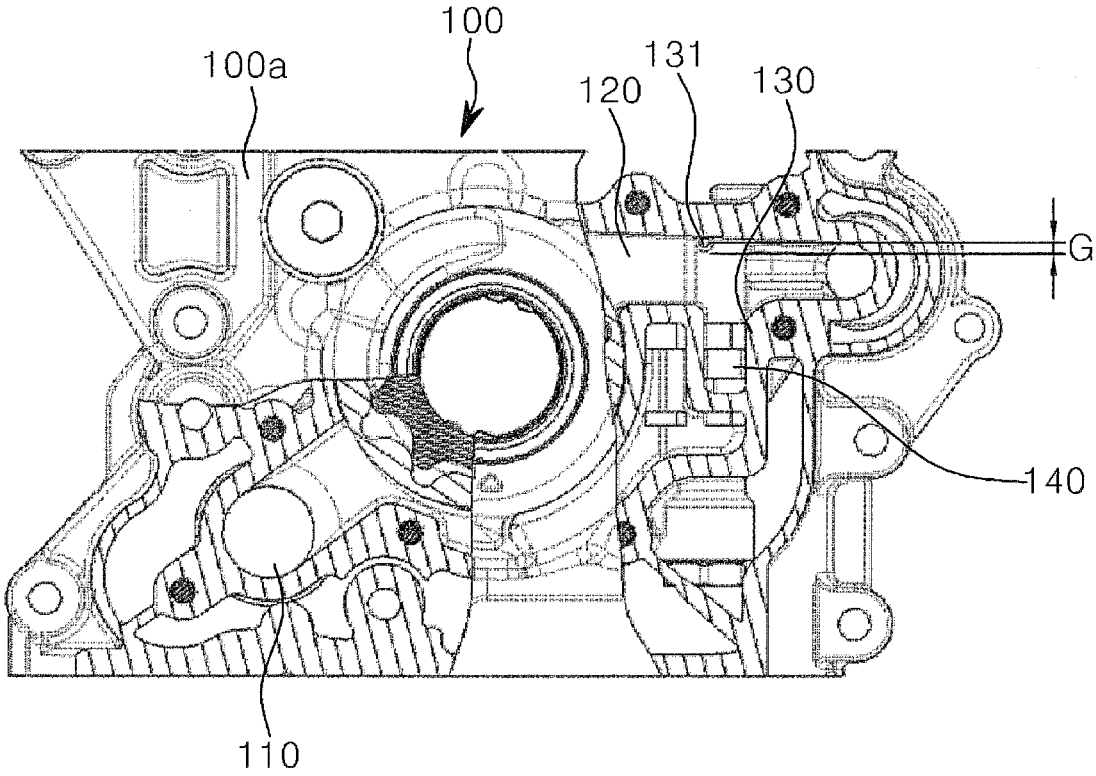
FIG. 1 is a cross-sectional view showing a structure of a variable oil pump in accordance with a first exemplary embodiment of the present invention.
Figure 2A:
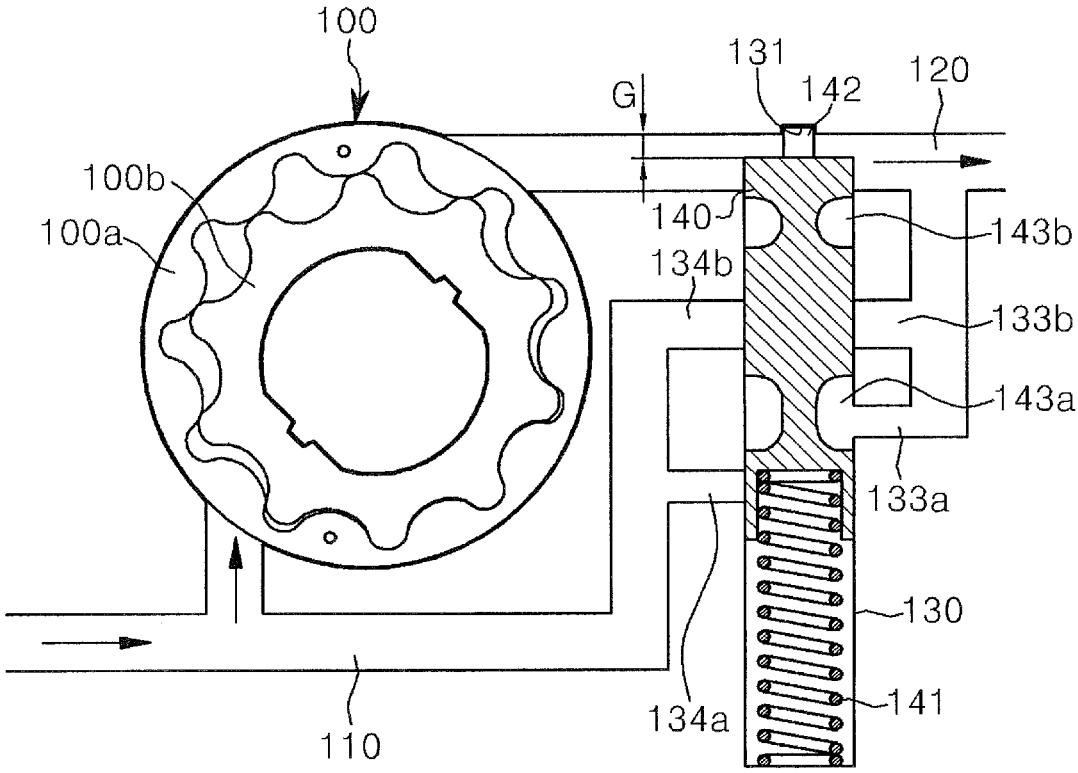
FIG. 2A is a schematic view showing an operating state of the variable oil pump in accordance with a first exemplary embodiment of the present invention in a low speed range.
Figure 2B:
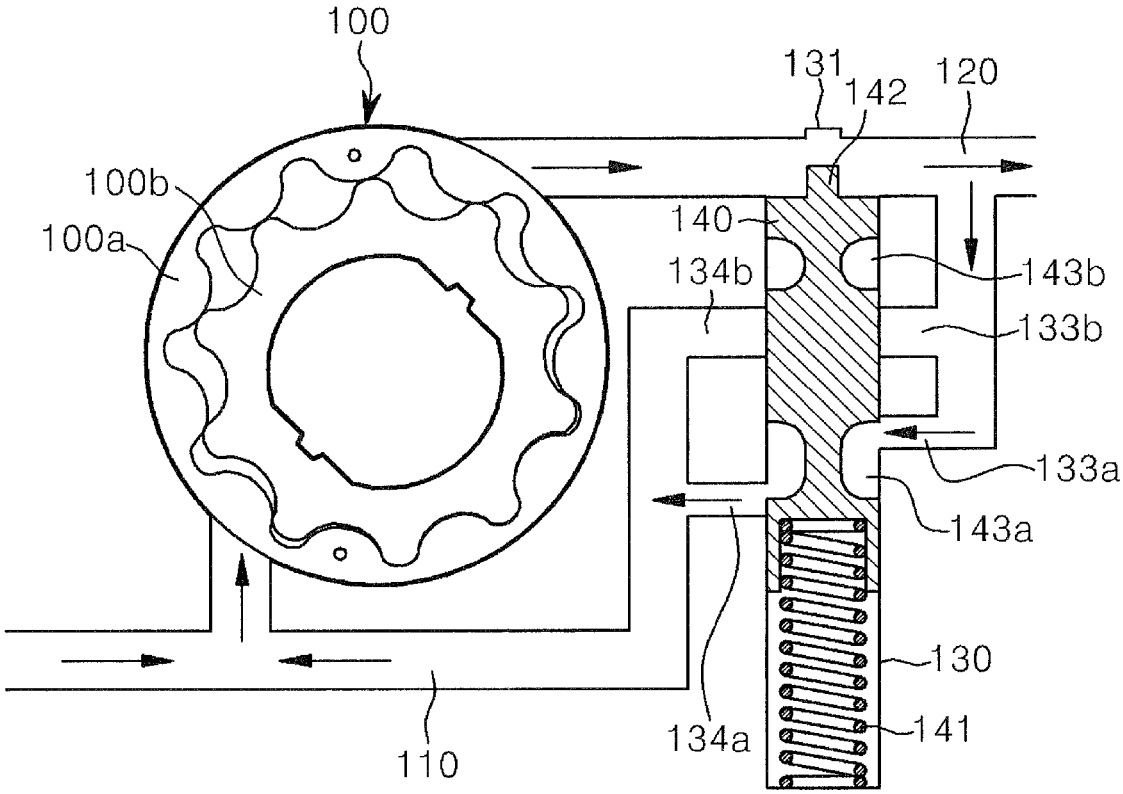
FIG. 2B is a schematic view showing an operating state of the variable oil pump in accordance with a first exemplary embodiment of the present invention in a medium speed range.
Figure 2C:
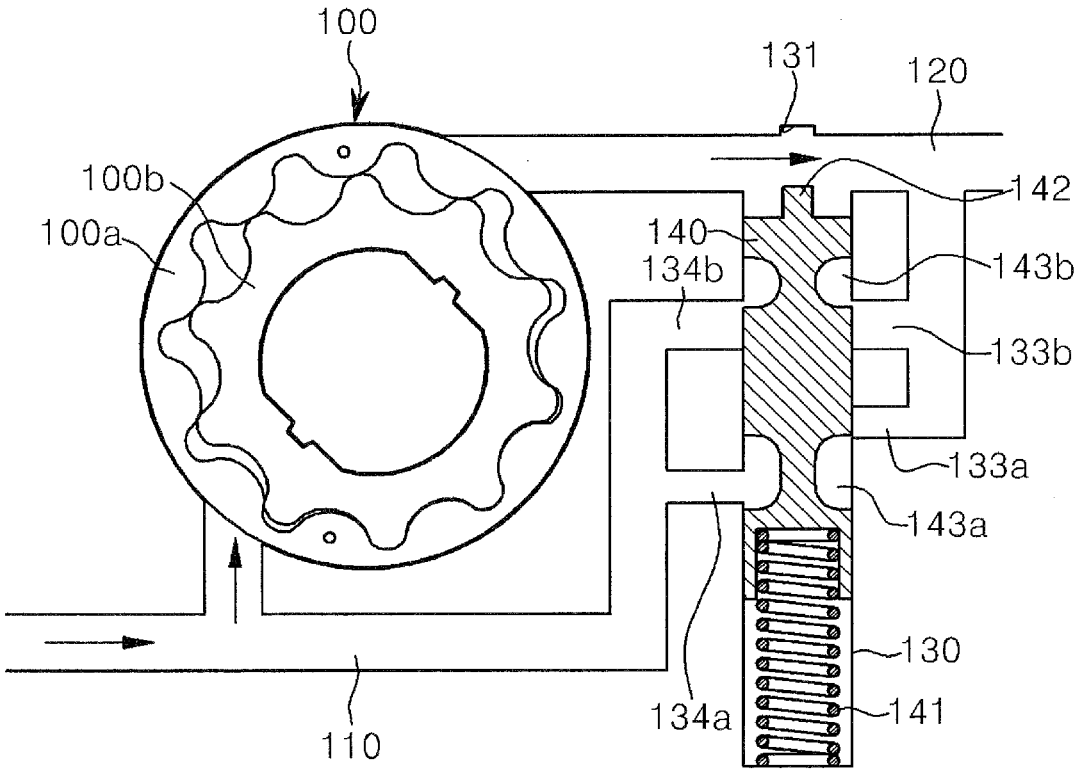
FIG. 2C is a schematic view showing an operating state of the variable oil pump in accordance with a first exemplary embodiment of the present invention in a medium/high speed range.
Figure 2D:
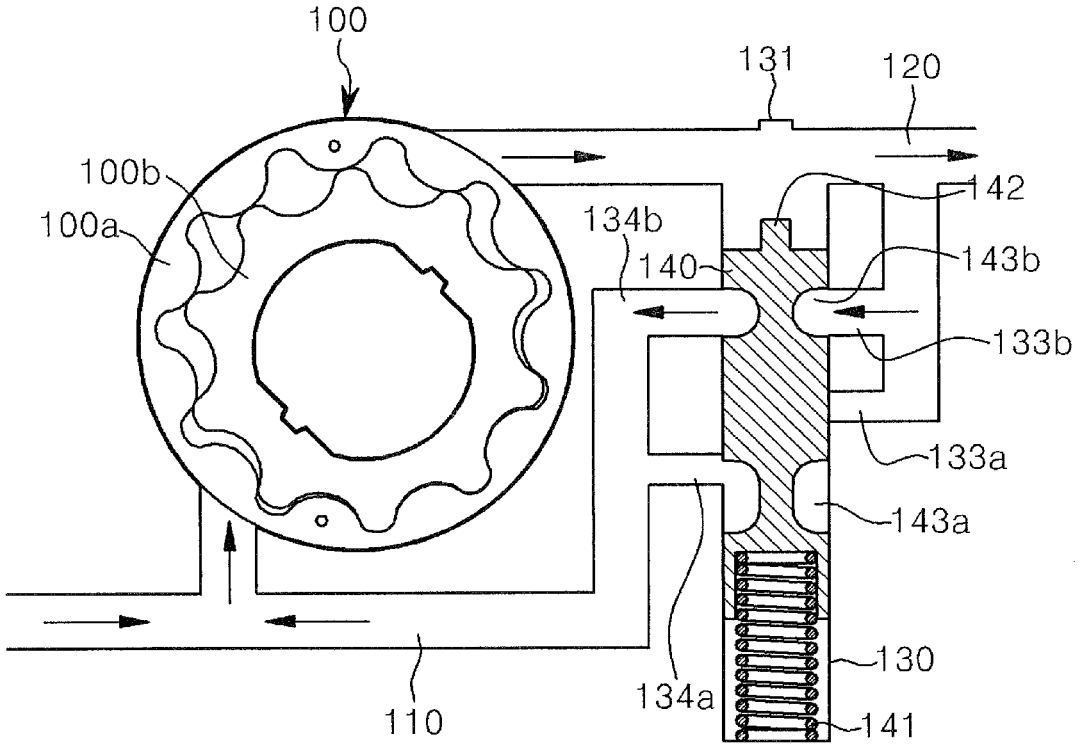
FIG. 2D is a schematic view showing an operating state of the variable oil pump in accordance with a first exemplary embodiment of the present invention in a high speed range.
Figure 3:
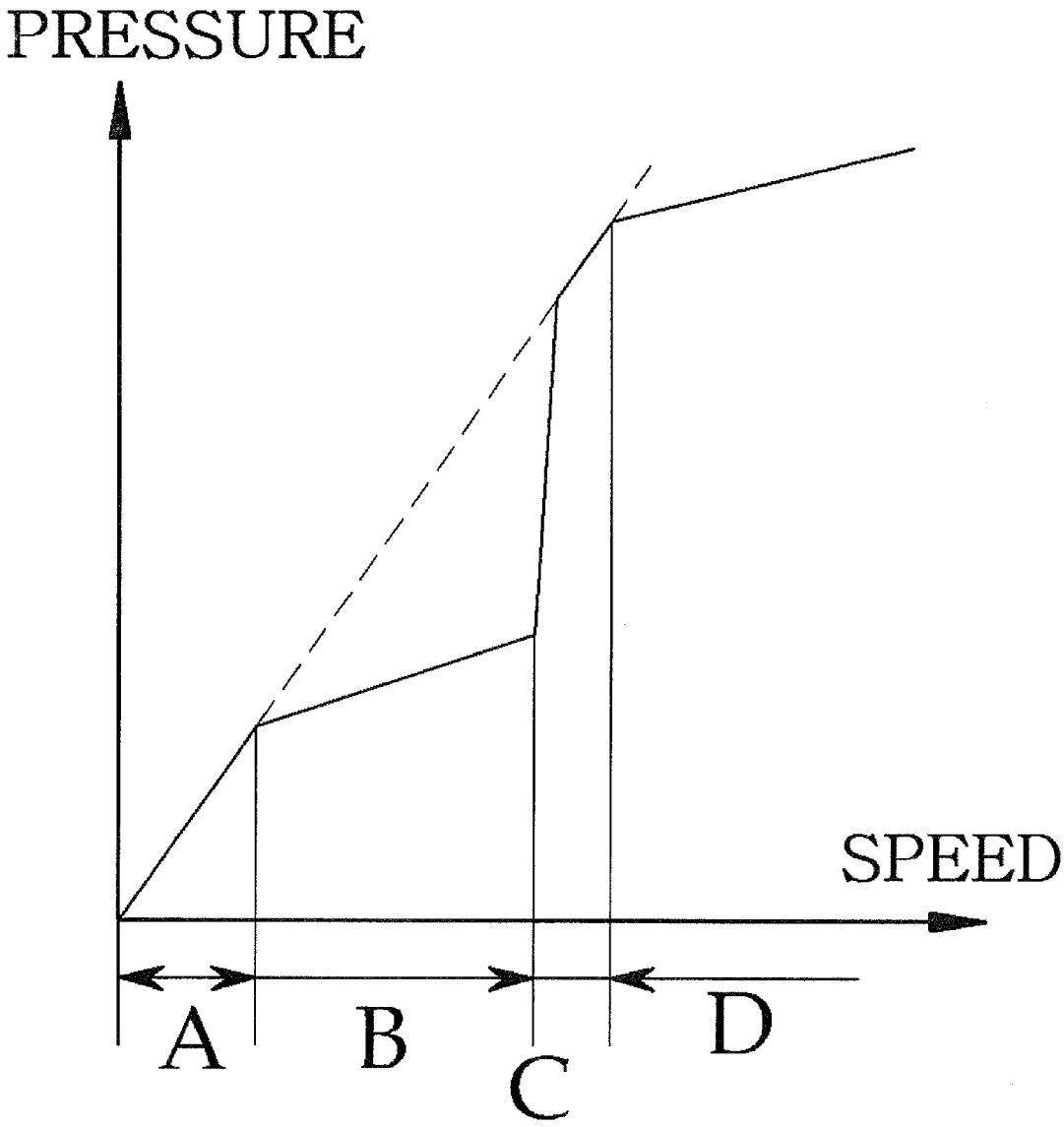
FIG. 3 is a graph showing variation in pressure of the variable oil pump in accordance with a first exemplary embodiment of the present invention according to an engine speed.

FIG. 1 is a cross-sectional view showing a structure of a variable oil pump in accordance with a first exemplary embodiment of the present invention, FIG. 2A is a schematic view showing an operating state of the variable oil pump in accordance with a first exemplary embodiment of the present invention in a low speed range, FIG. 2B is a schematic view showing an operating state of the variable oil pump in accordance with a first exemplary embodiment of the present invention in a medium speed range, FIG. 2C is a schematic view showing an operating state of the variable oil pump in accordance with a first exemplary embodiment of the present invention in a medium/high speed range, FIG. 2D is a schematic view showing an operating state of the variable oil pump in accordance with a first exemplary embodiment of the present invention in a high speed range, and FIG. 3 is a graph showing variation in pressure of the variable oil pump in accordance with a first exemplary embodiment of the present invention according to an engine speed.

A variable oil pump 100 in accordance with the present invention includes a cylinder 130 disposed between an outlet side 120 and an inlet side 110, through which oil is supplied as an oil pressure is generated by driving an engine, and a plunger 140 elastically supported in the cylinder 130 by an elastic spring 141.

In particular, the cylinder 130 is formed to expose a front end of the plunger 140 to the outlet side 120, and includes a first input pipe 133*a* and a second input pipe 133*b*, and a first output pipe 134*a* and a second output pipe 134*b* such that a portion of a hydraulic pressure of the outlet side 120 can be returned to the inlet side 110 according to an operation of the plunger 140 in a medium speed range B and a high speed range D.

In addition, the plunger 140 is elastically supported and has one end exposed to the outlet side 120, and includes a first pipe line 143*a* and a second pipe line 143*b* configured to form a flow path according to variation in oil of the outlet side 120. Further, the plunger 140 is configured such that an oil pressure of the outlet side 120 is in proportion to the engine RPM in a low speed range A and a medium/high speed range C to supply oil, and a portion of a flow rate of the outlet side 120 is returned to the inlet side 110 through the first pipe line 143*a* and the second pipe line 143*b* in the medium speed range B and the high speed range D, appropriately reducing the supply amount.

Hereinafter, such a configuration will be described in detail as follows.

The oil pump 100 includes a housing 100*a* having internal teeth, and a rotor 100*b* meshed with the internal teeth to be rotated therewith. In particular, the rotor 100*b* is connected to a crankshaft of the engine to be driven in proportion to the engine RPM. The configuration and operation of the gear-type oil pump 100 are well known in the art, and thus, detailed description thereof will be omitted.

Meanwhile, the oil pump 100 includes the inlet side 110 and the outlet side 120, which function as flow paths to supply a hydraulic pressure generated by rotation of the rotor 100*b*. The inlet side 110 and the outlet side 120 are generally formed at the housing 100*a*.

In addition, the outlet side 120 is formed to communicate with the cylinder 130. This is because the pressure of the outlet side 120 is directly applied to the cylinder 130 to be directly linked and operated with the plunger 140 installed therein. In the embodiment of the present invention, the cylinder 130 may be formed in a direction perpendicular to a flow of a fluid flowing through the outlet side 120. The hydraulic pressure is applied from a center to the outside due to characteristics of the hydraulic pressure. As the plunger 140 is operated by the hydraulic pressure perpendicularly applied with respect to a pipe line of the outlet side 120, the plunger can be immediately operated with respect to the applied pressure to improve a reaction speed.

In addition, a receiving hole 131 is formed in an upper end surface of the cylinder 130, i.e., an inner surface thereof in contact with the plunger 140. Here, the receiving hole 131 may provide a gap G between the plunger 140 and the cylinder 130 so that the hydraulic pressure is directly applied to the plunger 140.

Further, the cylinder 130 has the first and second input pipes 133*a* and 133*b* branched from the outlet side 120 to return the hydraulic pressure, and the first and second output pipes 134*a* and 134*b* configured to selectively discharge the hydraulic pressure to the inlet side 110. The first and second input pipes 133*a* and 133*b*, and the first and second output pipes 134*a* and 134*b* perform an opening/closing operation in four steps as the plunger 140 moves in a longitudinal direction thereof, and this will be described with the configuration of the plunger 140 as follows.

The plunger 140, which is a piston, is installed in the cylinder 130 to be elastically supported by the elastic spring 141. Here, the spring 141 may be provided with a cover (not shown) to be exchanged and used according to circumstances.

In particular, a protrusion 142 protrudes from an upper end of the plunger 140, i.e., a front end thereof exposed to the outlet side 120, to be partially inserted into the receiving hole 131. As described above, the protrusion 142 forms the gap G between the inner surface of the outlet side 120 and the upper end of the plunger 140.

In addition, the plunger 140 has the first pipe line 143*a* and the second pipe line 143*b* to communicate the first and second input pipes 133*a* and 133*b* with the first and second output pipes 134*a* and 134*b* while moving along the cylinder 130.

In the plunger 140, as a rotational speed of the oil pump 100, i.e., the engine RPM, is increased, the pressure of the outlet side 120 is gradually increased, and thus, the first pipe line 143*a* and the second pipe line 143*b* are opened or closed.

Hereinafter, in an operation of the plunger 140, the engine RPM, which affects variation in pressure of the outlet side 120, will be separately described with respect to the low speed range A, the medium speed range B, the medium/high speed range C, and the high speed range D as follows.

First, when a vehicle is started to increase a speed of the oil pump 100 to the low speed range A, as shown in FIG. 2A, the plunger 140 is elastically supported by the elastic spring 141 to maintain the state. Accordingly, both the first and second pipe lines 143*a* and 143*b* are closed by the cylinder 130, and the pressure of the outlet side 120 is increased in proportion to the engine RPM.

Next, as shown in FIG. 2B, when the engine RPM is in the medium speed range B, the plunger 140 is pushed down by the pressure of the outlet side 120. Here, the plunger 140 opens the first pipe line 143*a*. Accordingly, the pressure of the outlet side 120 is partially returned from the outlet side 120 to the inlet side 110 as the first input pipe 133*a* and the first output pipe 134*a* are connected to each other by the first pipe line 143*a*. Therefore, even when the speed is increased in the medium speed range B, the supply flow rate is reduced in proportion to the returned oil pressure.

Next, as shown in FIG. 2C, when the engine RPM is in the medium/high speed range C, the plunger 140 is further pushed down to close the opened first pipe line 143*a* (here, the second pipe line 143*b* is kept closed). Accordingly, the pressure of the outlet side 120 is increased, the pressure already lowered in the medium speed range B is increased, and thus, the oil pressure is increased until the pressure is in proportion to the engine RPM.

Finally, when the engine RPM is in the high speed range D, as shown in FIG. 2D, the plunger 140 is further pushed down to close the first pipe line 143*a* and open the second pipe line 143*b*. Accordingly, the second input pipe 133*b* and the second output pipe 134*b* are connected to each other to partially return the pressure of the outlet side 120 to the inlet side 110. As a result, in the high speed range D, a small amount of oil in comparison with the engine RPM is supplied.

[Second Embodiment]

Figure 4:
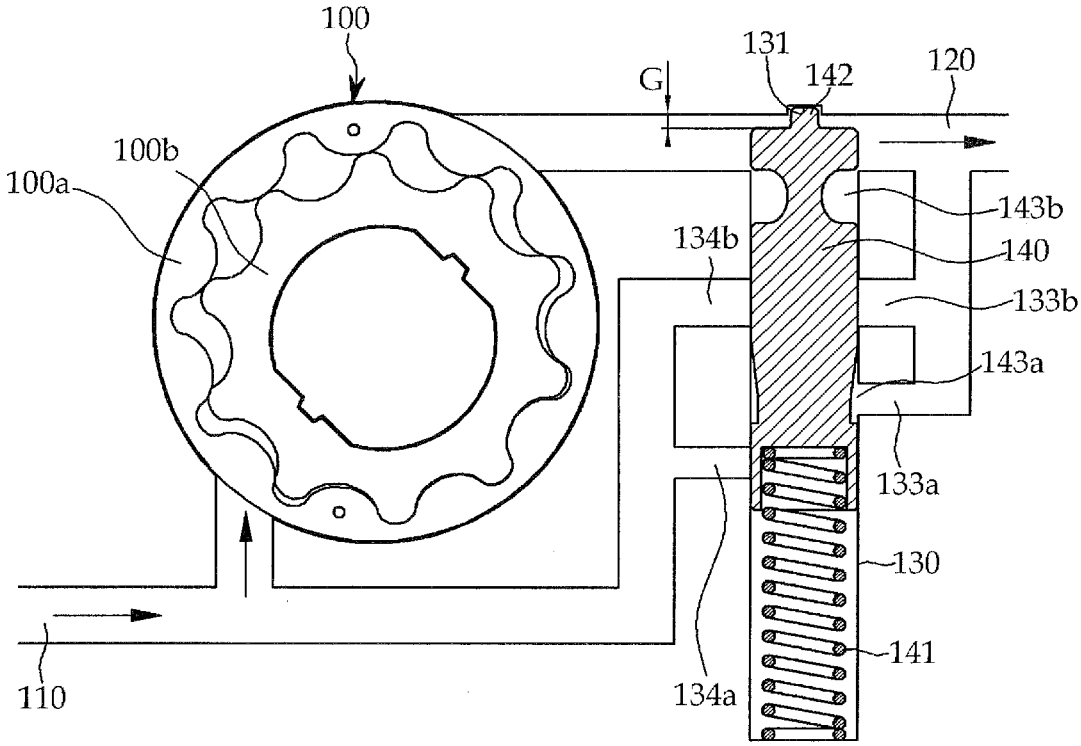
FIG. 4 is a cross-sectional view showing a configuration of a variable oil pump in accordance with a second exemplary embodiment of the present invention.
Figure 5:
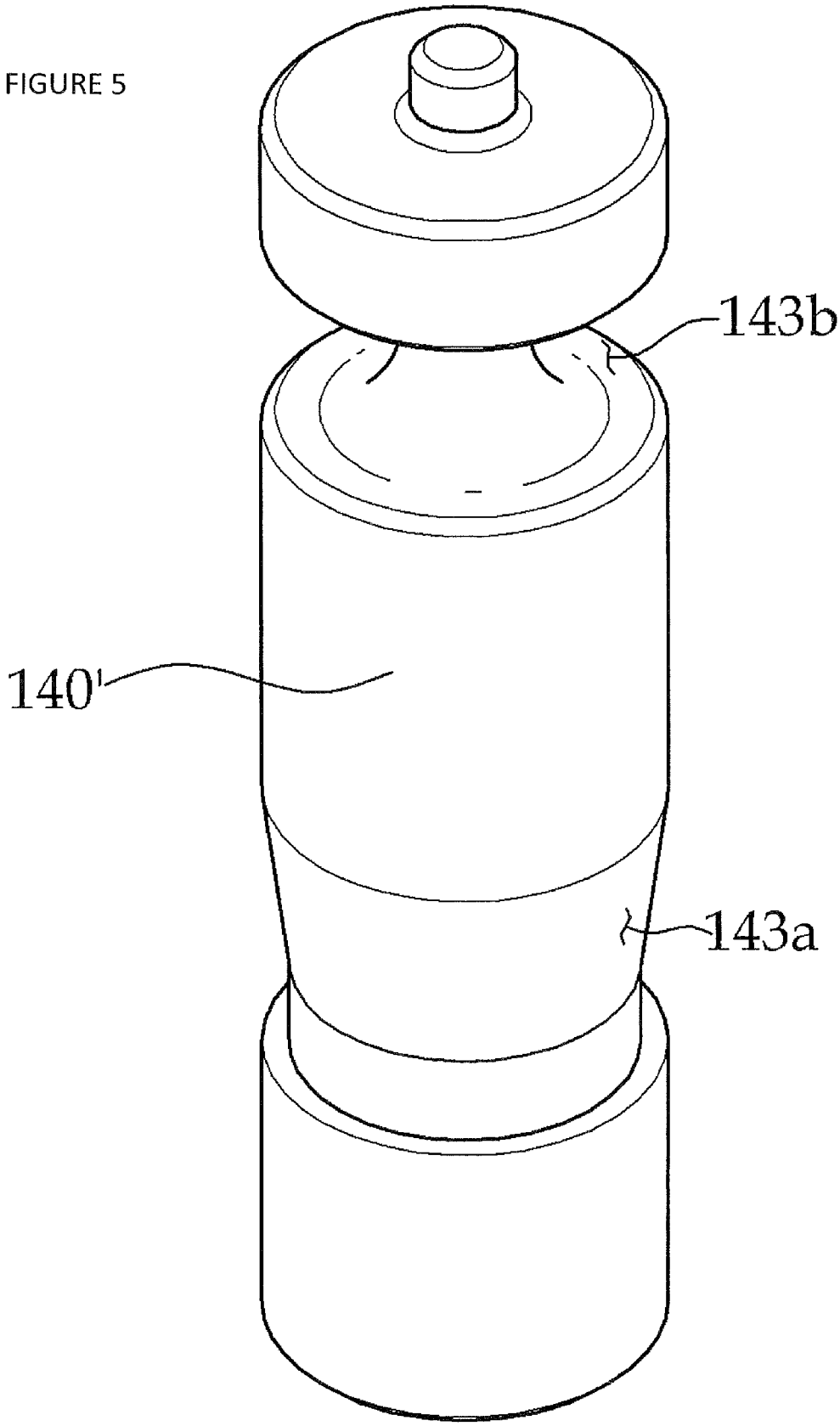
FIG. 5 is a perspective view showing a configuration of a plunger in accordance with a second exemplary embodiment of the present invention.
Figure 6:
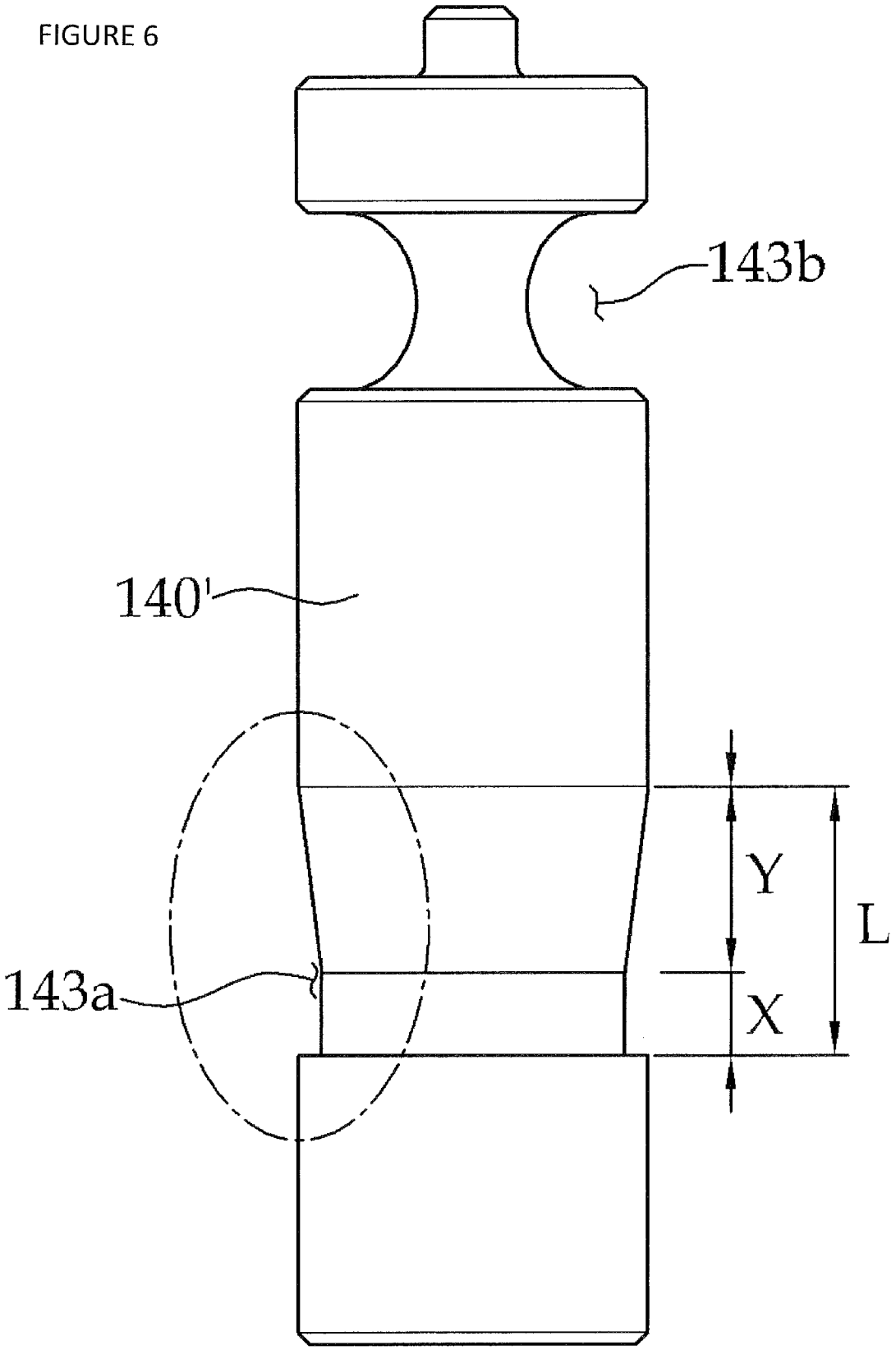
FIG. 6 is a plan view showing the configuration of the plunger in accordance with a second exemplary embodiment of the present invention.
Figure 7:
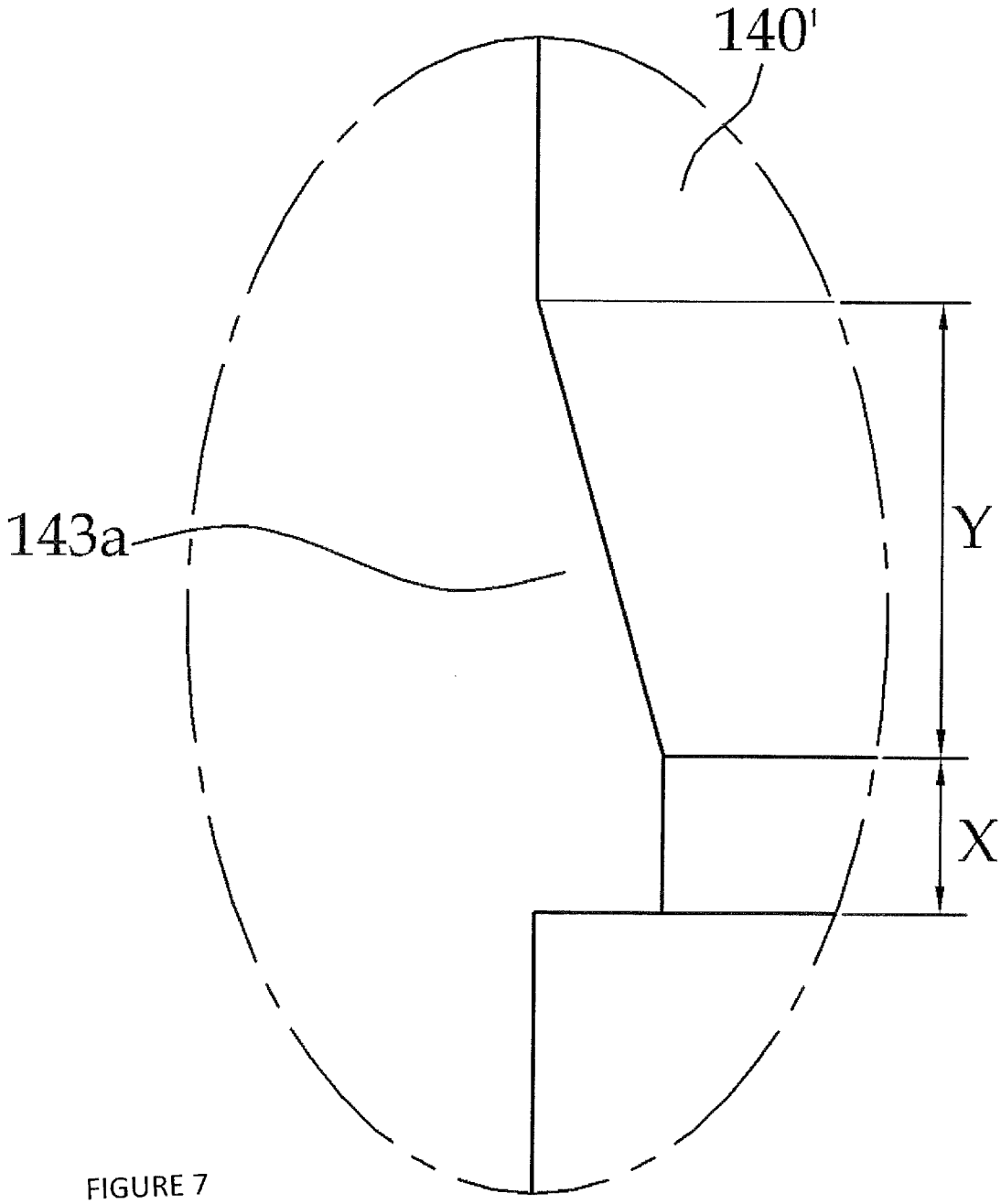
FIG. 7 is an enlarged view of a portion of FIG. 6.
Figure 8:
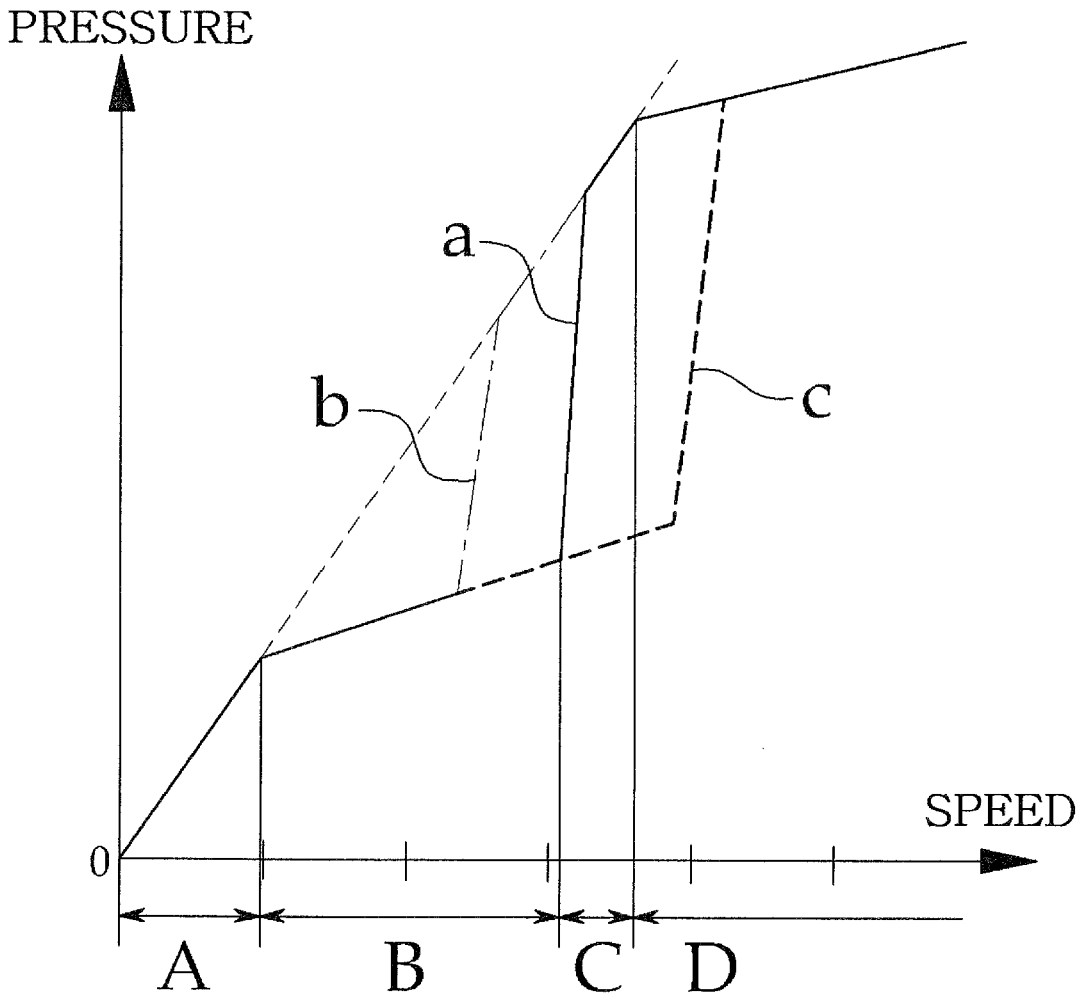
FIG. 8 is a graph showing variation in pressure of the variable oil pump in accordance with a second exemplary embodiment of the present invention according to an engine speed.

FIG. 4 is a cross-sectional view showing a configuration of a variable oil pump in accordance with a second exemplary embodiment of the present invention, FIG. 5 is a perspective view showing a configuration of a plunger in accordance with a second exemplary embodiment of the present invention, FIG. 6 is a plan view showing the configuration of the plunger in accordance with a second exemplary embodiment of the present invention, FIG. 7 is an enlarged view of a portion of FIG. 6, and FIG. 8 is a graph showing variation in pressure of the variable oil pump in accordance with a second exemplary embodiment of the present invention according to an engine speed. Here, like elements of the first embodiment are designated by like reference numerals, and thus, detailed description will not be repeated.

A variable oil pump in accordance with a second exemplary embodiment of the present invention is distinguished from the first embodiment by a configuration of a plunger 140'. That is, the plunger 140' is configured such that the oil pressure returned from the outlet side 120 to the inlet side 110 through the first pipe line 143*a* is decreased by a certain amount at the beginning, the decrement is gradually reduced, and thus, the pressure is increased in the high speed range in proportion to the decrement.

In order to perform the above-mentioned operation, as shown in FIGS. 6 and 7, the first pipe line 143*a* has a straight section X at which the first pipe line 143*a* is opened at the beginning according to an operation of the plunger 140', and a tapered section Y from an end point of the straight section X to a full open section. Here, the tapered section Y is formed in a shape enlarging outward from the end of the straight section X.

Here, the first pipe line 143*a*, which opens the first input pipe 133*a* and the second output pipe 134*a*, induces reduction in hydraulic pressure by a certain amount in the straight section X, which is an initial section, and induces gradual reduction in hydraulic pressure in the tapered section Y.

In particular, since reduction in the returned amount of hydraulic pressure by the tapered section Y means that the returned hydraulic pressure is reduced in the high speed range, the pressure is increased by the reduction in the returned amount.

In the exemplary embodiment, such a pressure increase point may satisfy a relation of $0.1X \leq L \leq 0.6X$ (here, $L=X+Y$) with respect to the total length L. This is because, when the straight section is 0.6X or more with respect to the total length L, the returned amount of hydraulic pressure is increased excessively and an effect of the increasing pressure is reduced as it approaches the high speed. In addition, this is because, when the straight section is 0.1X or less, the returned pressure is very low, an effect of reducing an initial pressure upon opening of the first pipe line 143*a* is decreased, and it becomes a pressure increase point.

That is, in the entire section L, when the straight section X is increased and the tapered section Y is decreased, since the returned amount of hydraulic pressure is increased, the pressure increase point is lowered. On the other hand, when the straight section X is reduced and the tapered section Y is increased, since the returned amount of hydraulic pressure is reduced at the beginning, the pressure increase point is increased.

Accordingly, as shown in FIG. 8, a conventional pressure variation graph "a" moves to "b" to lower the pressure increase point when the straight section X is increased to increase the returned pressure, and on the other hand, when the straight section X is reduced to reduce the returned pressure, the graph moves to "c" to increase the pressure increase point.

Figure 9:
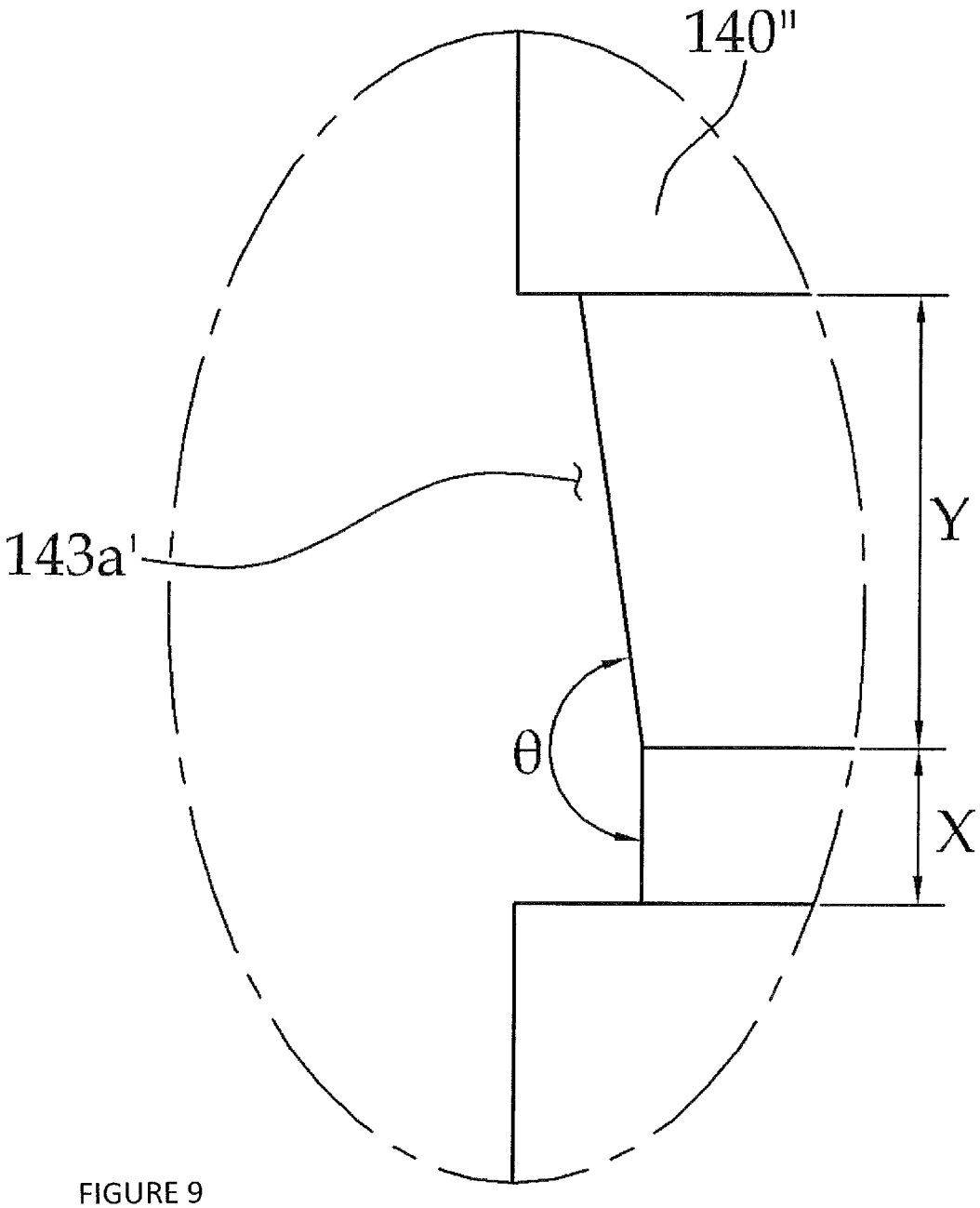
FIG. 9 is a partially enlarged view showing a variant of the plunger in accordance with the present invention.

Meanwhile, a plunger 140" in accordance with a second exemplary embodiment of the present invention may have a first pipe line 143*a*", in which an end of the tapered section Y is stepped when seen from a cross-sectional view. That is, as shown in FIG. 9 illustrating a variant of the plunger in accordance with the present invention, the cross-sectional shape of the first pipe line 143*a*" has a stepped end of the tapered section Y continuously connected to the straight section X.

Accordingly, an inclination angle Θ between the tapered section Y and the straight section X can be further increased, and thus, a large amount of hydraulic pressure in comparison with the plunger 140' of the first embodiment can be returned. Therefore, an adjustment range of the returned hydraulic pressure is increased, and thus, an increase position upon the pressure increase can be varied and used in a wider range. Here, reference numeral Θ represents the inclination angle of the first embodiment.

As described above, the plunger of the present invention, which is elastically supported, is configured to selectively form a flow path while being operated according to variation in oil pressure, so that the plunger can rapidly react to supply the flow rate required according to each of the sections with a simple structure.

As can be seen from the foregoing, the variable oil pump in accordance with the present invention has the following effects.

1) As the plunger protruding toward the outlet side is immediately operated by the oil pressure of the outlet side, an appropriate oil amount can be rapidly and flexibly supplied according to the engine RPM.

2) Since there is always a gap between the outlet side and the plunger, when the hydraulic pressure is varied, the variation in hydraulic pressure is immediately reflected in the plunger through the gap such that the variation in engine RPM can be rapidly dealt with.

3) As the pressure of the working fluid is applied from the center to the outer side of the pipe line and the plunger of the invention is installed to operate in the direction perpendicular to the flowing direction of the working fluid, a pressure direction of the working fluid coincides with a moving direction of the plunger so that the plunger can be more rapidly reacted by the variation in pressure of the working fluid, reflecting variation in oil amount of the working fluid.

While the invention has been shown and described with reference to certain example embodiments thereof, it will be understood by those skilled in the art that various changes in form and details may be made therein without departing from the spirit and scope of the invention as defined by the appended claims.

What is claimed is:

1. A rotor-type variable oil pump configured to vary a pressure and output the pressure according to an engine RPM, said oil pump (100) comprising:

a cylinder (130) connected to an outlet pipe (120) and having a first input pipe (133*a*) and a second input pipe (133*b*) branched from the outlet pipe (120), and a first output pipe (134*a*) and a second output pipe (134*b*) branched from an inlet side (110), a plunger (140) having a first pipe line (143*a*) and a second pipe line (143*b*) installed in the cylinder (130) and configured in a way such that one end of the plunger is exposed in the outlet pipe (120) while the other end is elastically supported by an elastic spring (141) in the cylinder (130), and said plunger (140) being compressible in a longitudinal direction of the cylinder (130) according to variation in pressure of the outlet pipe (120) to supply oil in proportion to the engine RPM, wherein in a low speed range (A) and a medium/high speed range (C), said oil pump is configured in a way such that the first pipe line (143*a*) and second pipe line (143*b*) of the plunger (140) are closed by the cylinder (130), wherein in a medium speed range (B), the oil pump is configured in a way such that the first pipe line (143*a*) connects the first input pipe (133*a*) to the first output pipe (134*a*) to partially return a hydraulic pressure of the outlet pipe (120) to the inlet side (110), and wherein in a high speed range (D), the oil pump is configured in a way such that the second pipe line (143*b*) connects the second input pipe (133*b*) to the second output pipe (134*b*) to partially return the hydraulic pressure of the outlet pipe (120) to the inlet side (110).

2. A rotor-type variable oil pump configured to vary a pressure and output the pressure according to an engine RPM, said oil pump (100) comprising:

a cylinder (130) connected to an outlet side (120) and having a first input pipe (133*a*) and a second input pipe (133*b*) branched from the outlet side (120), and a first output pipe (134*a*) and a second output pipe (134*b*) branched from an inlet side (110), a plunger (140) having a first pipe line (143*a*) and a second pipe line (143*b*) installed in the cylinder (130) and configured in a way such that one end of the plunger is exposed to the outlet side (120) while the other end is elastically supported by an elastic spring (141) in the cylinder (130), and said plunger (140) being compressible in a longitudinal direction of the cylinder (130) according to variation in pressure of the outlet side (120) to supply oil in proportion to the engine RPM, wherein in a low speed range (A) and a medium/high speed range (C) said oil pump is configured in a way such the first pipe line (143*a*) and second pipe line (143*b*) of the plunger (140) are closed by the cylinder (130), wherein in a medium speed range (B), the oil pump is configured in a way such that the first pipe line (143*a*) connects the first input pipe (133*a*) to the first output pipe (134*a*) to partially return a hydraulic pressure of the outlet side (120) to the inlet side (110), wherein in a high speed range (D), the oil pump is configured in a way such that the second pipe line (143*b*) connects the second input pipe (133*b*) to the second output pipe (134*b*) to partially return the hydraulic pressure of the outlet side (120) to the inlet side (110), wherein a protrusion (142) protrudes from a front end of the plunger (140) exposed to the outlet side (120) to maintain a gap, and a receiving hole (131) is formed in a portion of the cylinder (130) in contact with the protrusion (142) so that a portion of the protrusion (142) is receivable in the receiving hole (131).

3. The variable oil pump according to claim 1 or 2, wherein the cylinder (130) is perpendicularly formed with respect to a fluid flow of the outlet side (120).

4. The variable oil pump according to claim 1 or 2, wherein the plunger (140) comprises a straight section (X) configured to reduce a hydraulic pressure by a certain amount during an initial opening of the first pipe line (143*a*), and a tapered section (Y) configured to gradually reduce a pressure decrease amount from the straight section (X).

5. The variable oil pump according to claim 4, wherein the tapered section (Y) has a stepped portion at an end thereof.

6. The variable oil pump according to claim 5, wherein the straight section (X) and the tapered section (Y) have a relation of $0.1X \leq L \leq 0.6X$, where, $(L=X+Y)$.

7. A rotor-type variable oil pump configured to vary a pressure and output the pressure according to an engine RPM, said oil pump (100) comprising:

a cylinder (130) connected to an outlet side (120) and having a first input pipe (133*a*) and a second input pipe (133*b*) branched from the outlet side (120), and a first output pipe (134*a*) and a second output pipe (134*b*) branched from an inlet side (110), a plunger (140) having a first pipe line (143*a*) and a second pipe line (143*b*) installed in the cylinder (130) and configured in a way such that one end of the plunger is exposed to the outlet side (120) while the other end is elastically supported by an elastic spring (141) in the cylinder (130), and said plunger (140) being compressible in a longitudinal direction of the cylinder (130) according to variation in pressure of the outlet side (120) to supply oil in proportion to the engine RPM, wherein in a low speed range (A) and a medium/high speed range (C) said oil pump is configured in a way such the first pipe line (143*a*) and second pipe line (143*b*) of the plunger (140) are closed by the cylinder (130), wherein in a medium speed range (B), the oil pump is configured in a way such that the first pipe line (143*a*) connects the first input pipe (133*a*) to the first output pipe (134*a*) to partially return a hydraulic pressure of the outlet side (120) to the inlet side (110), wherein in a high speed range (D), the oil pump is configured in a way such that the second pipe line (143*b*) connects the second input pipe (133*b*) to the second output pipe (134*b*) to partially return the hydraulic pressure of the outlet side (120) to the inlet side (110), wherein a protrusion (142) protrudes from a front end of the plunger (140) exposed to the outlet side (120) to maintain a gap, and a receiving hole (131) is formed in a portion of the outlet side in contact with the protrusion (142) so that a portion of the protrusion (142) is receivable in the receiving hole (131).

* * * * *